United States Patent [19]

Cacicedo

[11] 4,079,481

[45] Mar. 21, 1978

[54] DOUBLE-HINGED GATE HINGE

[76] Inventor: Paulino A. Cacicedo, 42 Old Indian Rd., West Orange, N.J. 07052

[21] Appl. No.: 764,335

[22] Filed: Jan. 31, 1977

[51] Int. Cl.[2] ..... E05D 5/02

[52] U.S. Cl. ..... 16/158; 248/230

[58] Field of Search ..... 16/158, 187, 130, 131; 248/230; 49/388; 256/67, 68

[56] References Cited

U.S. PATENT DOCUMENTS

| | | | |
|---|---|---|---|
| 1,283,359 | 10/1918 | Thomson | 16/158 UX |
| 2,970,799 | 2/1961 | Pinson | 248/230 |
| 3,347,572 | 10/1967 | Pfaff, Jr. et al. | 248/230 X |
| 3,727,266 | 4/1973 | Ashworth | 16/158 |
| 3,811,149 | 5/1974 | Griffin | 16/158 X |
| 4,010,504 | 3/1977 | Griffin | 16/158 |

*Primary Examiner*—James Kee Chi

*Attorney, Agent, or Firm*—Carella, Bain, Gilfilian & Rhodes

[57] ABSTRACT

A double-hinged gate hinge including a pair of pivotable members, such as a pair of links of chain, one end of each pivotable member being secured pivotally to a hinge pin receiving block and the other end of each pivotable member being secured pivotally to a fitting having a bore extending therethrough. Upon the hinge pin receiving block being placed on one side of a post and upon a bolt, such as a U-bolt, being placed on the opposite side of the post, and upon the threaded ends of the bolt being passed through the fitting bores and upon threaded nuts being secured to the ends of the threaded bolt, the hinge pin receiving block and bolt being drawn towards each other and the pivotable members being caused to pivot with respect to the hinge pin receiving block and experience double-hinge action and thereby conform generally to the post and posts of different diameters. In one embodiment, each pivotable member is only pivotally mounted at one end, the end connected to the hinge pin receiving block, and the other end of each pivotable member is provided with a radially outwardly extending portion provided with an oversized bore for receiving the threaded ends of the bolt whereby the gate hinge may be secured to posts of different diameter.

9 Claims, 4 Drawing Figures

DOUBLE-HINGED GATE HINGE

BACKGROUND OF THE INVENTION

The present invention relates generally to gate hinges and in particular to a double-hinged gate hinge for being secured to posts of different diameters.

As is known to those skilled in the gate hinge art, and in particular the gate hinge art as related to metal fences wherein gates are hingedly mounted on a vertically extending metal gate post by a gate hinge, metal gate posts come in various diameters and the structure of the typical prior art gate hinge is such that a different sized gate hinge is required to mount a gate to gate posts of different diameters.

The requirement of having to provide gate hinges of different diameters causes unwanted expense and presents the annoying problem of requiring the maintenance of a large supply of different sized gate hinges to assure that for any given installation the proper sized gate hinge is in supply.

SUMMARY OF THE INVENTION

Accordingly, in view of the foregoing background information, it is the object of the present invention to provide a gate hinge which may be used to secure a gate hinge to gate posts of different diameters.

The gate hinge of the present invention, satisfying the foregoing object and solving the above-noted prior art problem, may include a pair of pivotable members, such as a pair of links of chain with one end of each pivotable member being secured pivotally to a hinge pin receiving block and with the other end of each pivotable member being secured pivotally to a fitting having a bore extending therethrough for slidably receiving the threaded ends of a bolt, such as a U-bolt. The pair of pivotable members provide double-hinge action by pivoting with respect to the hinge pin receiving block and conforming generally to the gage post regardless of its diameter.

DESCRIPTION OF THE PREFERRED EMBODIMENT OF THE INVENTION

Figure 1:
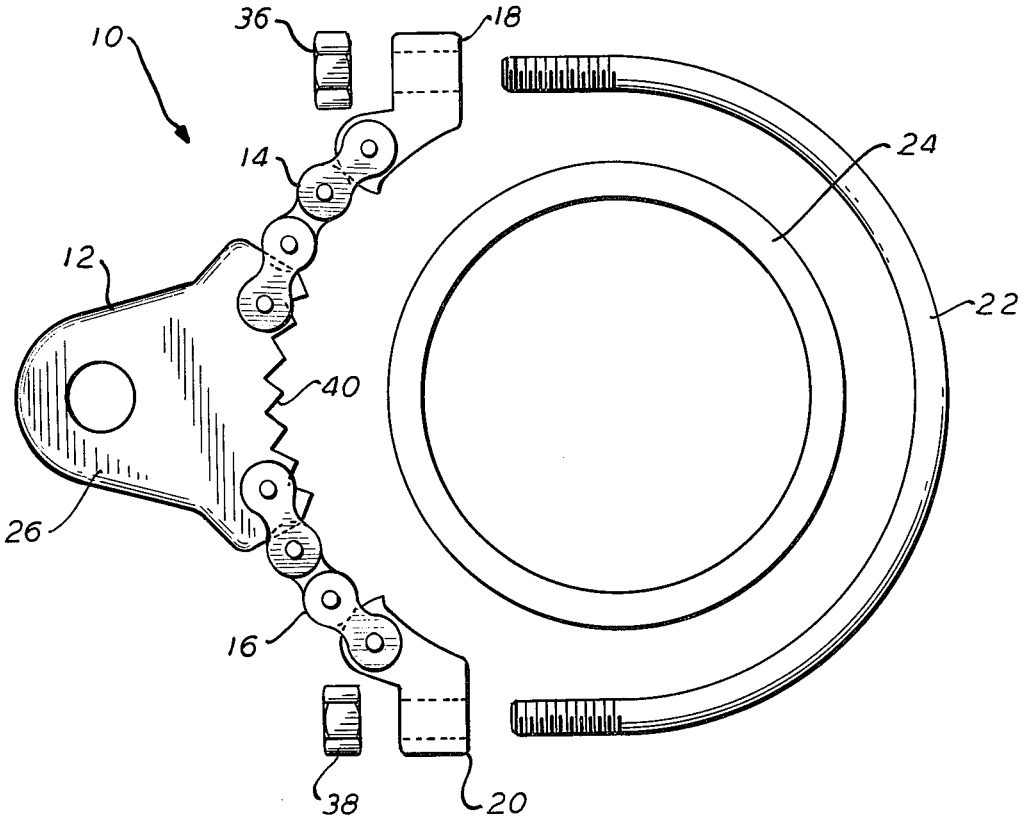
FIG. 1 is a top view of a double-hinged gate hinge according to the present invention.

Referring now to the drawings, and in particular to FIG. 1, there is shown a double-hinged gate hinge embodying the present invention and being identified by general numerical designation 10.

The double-hinged gate hinge pin 10 includes a hinge pin receiving block 12, a pair of pivotable members 14 and 16, and a pair of fittings 18 and 20. Also, a bolt, such as U-bolt 22, may be provided to complete the gate hinge and the use of a U-bolt or straight bolt is taught below in accordance with the further explanation of the present invention.

The double-hinged gate hinge 10 is for being secured to a gate post such as a gate post 24, and in particular, is for being secured to gate posts of different diameters due to the double-hinge action of the pivotable members 14 and 16 as also taught in detail below.

Referring again to FIG. 1, one end of each of the pivotable members 14 and 16 is secured pivotally to the hinge pin receiving block and the other end of each pivotable member is secured pivotally to either the fitting 18 or the fitting 20, as shown.

Figure 2:
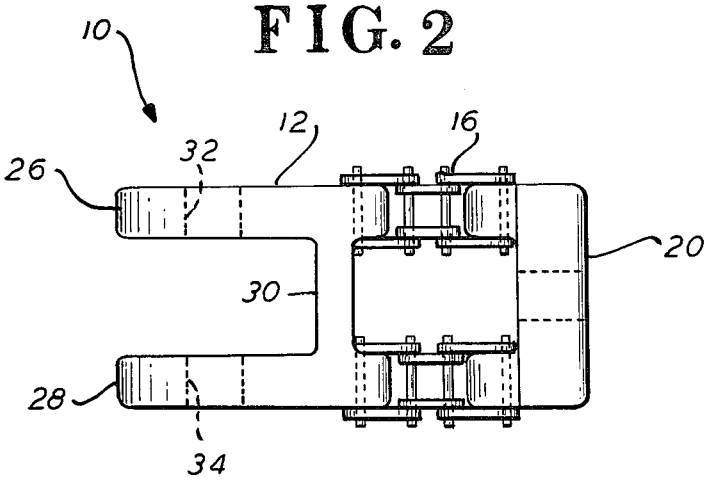
FIG. 2 is a side view of a portion of the structure shown in FIG. 1, in particular a hinge pin receiving block and a pair of pivotable members secured pivotally to the hinge pin receiving block.

As may be seen from both FIGS. 1 and 2, the hinge pin receiving block 12 is provided with a pair of opposed and horizontally extending brackets portions 26 and 28 which may be structurally interconnected by an integrally formed and vertically extending bracket portion 30. As may be best seen in FIG. 2, the horizontally extending portions 26 and 28 of the hinge pin receiving block are provided respectively with vertically aligned bores 30 and 32 for receiving a hinge pin, not shown, for hingedly mounting a fence gate, also not shown, to the gate post 24.

In operation, and in accordance with the teachings of the present invention, the hinge pin receiving block is placed on one side of a gate post, such as gate post 24, and the bolt, such as U-bolt 22, is placed on the opposite side of the gate post and the threaded ends of the bolt are extended through the fitting bores 18 and 20 and appropriately sized threaded nuts 36 and 38 are threadedly secured to the ends of the bolt to draw the hinge pin receiving block 12 and bolt towards each other and against the gate post 24. The threaded engagement of the nuts 36 and 38 with the threaded ends of the bolt 22 and the drawing of the bolt and hinge pins toward each other and against the gate post 24 also causes the pivotable members 14 and 16 to perform their double-hinge action by pivoting with respect to the hinge pin receiving block 12 and towards each other and into engagement with the gate post 24 thereby conforming generally to the gate post 24 and gate posts of other and different diameters. Accordingly, it will be understood by those skilled in the gate hinge art that such double-hinge action provided by the pair of pivotable members 14 and 16 permits the gate hinge 10 of the present invention to conform to gate posts of different diameters.

As shown in the drawings, the pair of pivotable members 14 and 16 may be comprised advantageously of links of chain or other pivotable structural members such as metal straps, metal cables, flexible rings, clips and hooks or leather straps.

Referring again to FIG. 1, it will be noted that the hinge pin receiving block 12 of the present invention may be provided advantageously with a serrated surface or portion 40 for providing increased frictional engagement between the hinge pin receiving block and the gate post 24.

It will be further understood by those skilled in the gate hinge art that depending upon the diameter of the fence post 24, a bolt such as the U-bolt 22 shown may be employed, or if the fence post 24 is of sufficiently small diameter, the flexible members 14 and 16 may perform their double-hinge action and conform to the smaller diameter gate post such that the bores 36 and 38 formed in the fittings 18 and 20, respectively, may be placed in longitudinal alignment whereupon a straight bolt may be used to secure the hinge pin receiving block to the smaller diameter post gate.

Figure 3:
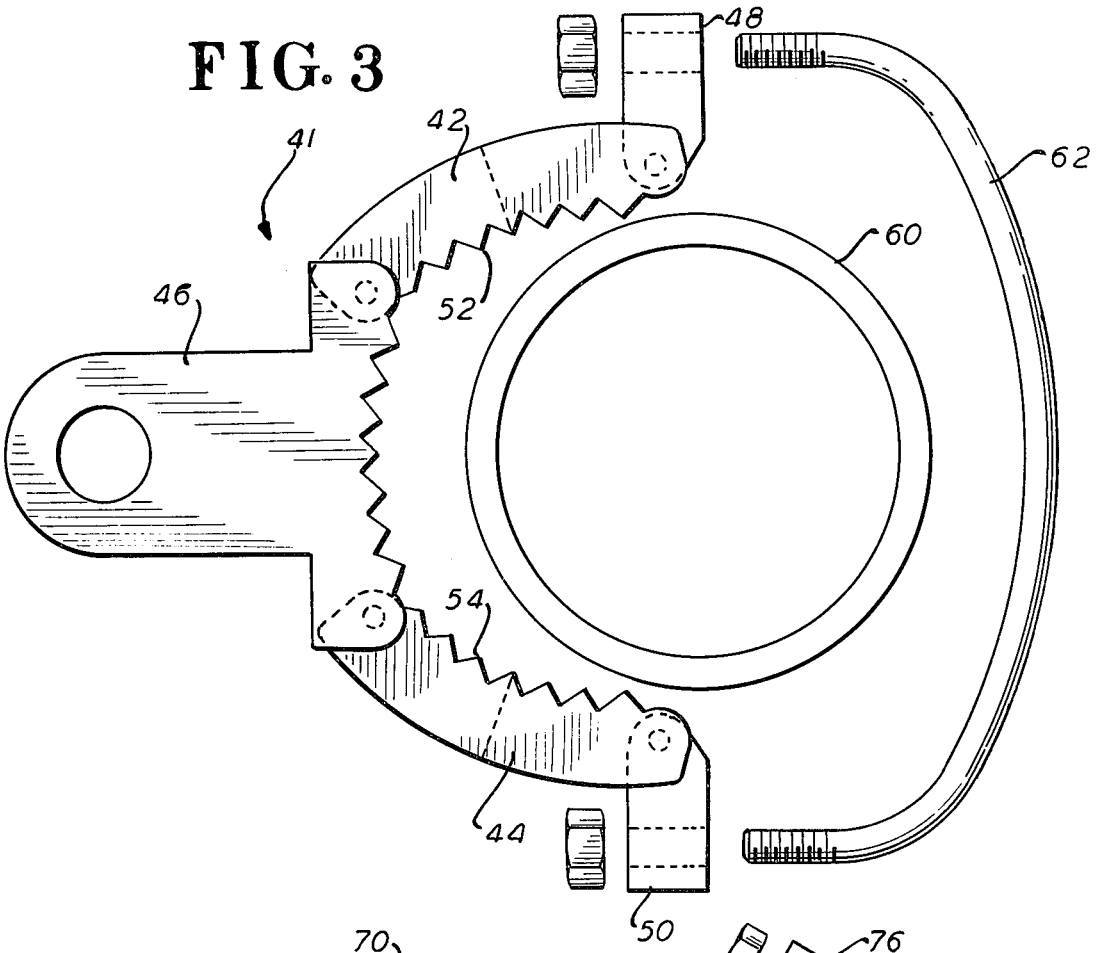
FIGS. 3 and 4 are top views of alternate embodiments of double-hinged gate hinges according to the present invention.

Referring now to FIG. 3, there is shown an alternate embodiment 41 of the gate hinge of the present invention wherein the pair of pivotable members 14 and 16 are embodied as a pair of rigid generally arcuate shaped pivotable members 42 and 44 which are, respectively, pivotally connected to the hinge pin receiving block 46 and the fittings 48 and 50, as shown. It will be also understood that the surfaces of the rigid generally arcuate shaped pivotable members 42 and 44, surfaces 52 and 54, respectively, are provided with serrations to provide increased frictional engagement between the rigid generally arcuate shaped pivotable members 42 and 44 and the post 60.

As with regard to the embodiment of the present invention disclosed in FIGS. 1 and 2, and described above, the embodiment of FIG. 3 may further include a U-bolt 62 or a straight bolt, not shown, depending upon the diameter of the post 60 to which the gate hinge 41 may be frictionally secured in the same manner as the earlier embodiment as taught in detail above. The double-hinged gate hinge 41 of FIG. 3 operates in substantially the same manner as the embodiment of FIGS. 1 and 2.

Figure 4:
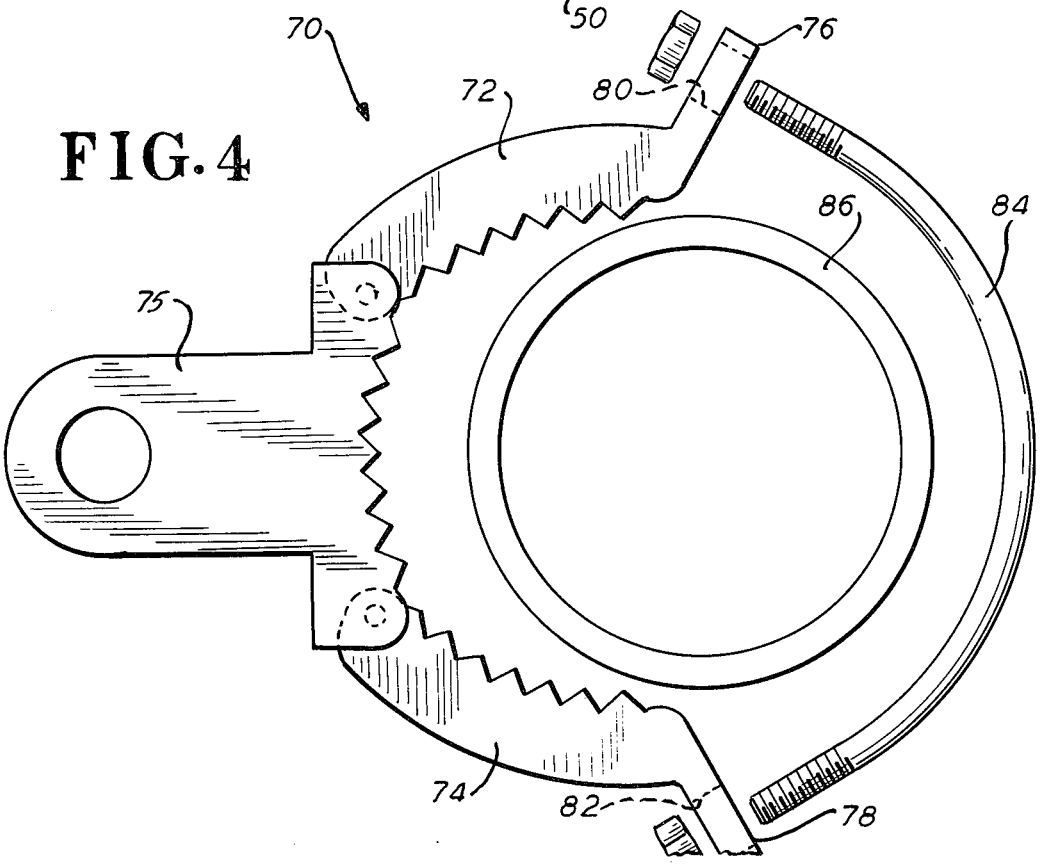

Referring now to FIG. 4, there is shown a still further embodiment 70 of the double-hinged gate hinge of the present invention. Similar to the above described two alternate embodiments of the double-hinged gate hinge of the present invention, the embodiment of FIG. 4 is also provided with a pair of pivotable members 72 and 74, but unlike the two foregoing alternate embodiments, the pair of pivotable members 72 and 74 of this embodiment are only pivotally connected to the hinge pin receiving block 75 and hence each pivotable member 72 and 74 is only pivotally interconnected at one point, as shown. However, the gate hinge 70 of FIG. 4 is also able to be secured to and to accommodate posts of different diameters by providing each of the pivotable members 72 and 74 at their non-pivoted ends with radially outwardly extending portions 76 and 78, as shown, which radially outwardly extending portions are provided with oversized bores 80 and 82, respectively. Such oversized bores 80 and 82 are oversized in the sense that they are predeterminely larger in diameter than the diameter of the threaded ends of the bolt 84. Accordingly, it will be understood by those skilled in the gate hinge art that the oversized bores 80 and 82 permit the threaded ends of the generally U-shaped bolt 84 to extend farther through, or less farther through such overzied bores depending upon the diameter of the fence post 86 to be engaged and to which the gate hinge 70 is to be secured. It will be further understood by those skilled in the gate hinge art that the gate hinge 70 of FIG. 4 will have general application for gate posts of different diameter in that the bolt 84 may be initially either a straight bolt or a U-shaped bolt of sufficient deformability that depending upon the specific application involved the installer may bend and shape the bolt 84 at the installation such that it will generally conform to a portion of the gate post 86 and such that the threaded ends thereof will be readily passed through the oversized bores 80 and 82 formed on the pivotable members 72 and 74. The pivotable members 72 and 74 may be of either the rigid generally arcuate configuration as shown or of the links of chain configuration of FIG. 1.

The structural members of the various embodiments of the present invention may be made of a suitable metal or metal alloy such as aluminum or steel or their alloys, or otherwise as specifically taught above.

It will be still further understood by those skilled in the art that many variations and modifications may be made in the present invention without departing from the spirit and the scope thereof.

What is claimed is:

1. A double-hinged gate hinge for being secured to posts of different diameters, comprising:

a bolt having threaded ends for receiving threaded nuts;

a hinge pin receiving block;

a pair of pivotable members;

a pair of fittings, each fitting having a bore extending therethrough for slidably permitting one end of said bolt to extend therethrough;

one end of each of said pivotable members being secured pivotally to one side of said hinge pin receiving block and the other end of each of said pivotable members being secured pivotally to one of said pair of fittings;

upon said hinge pin receiving block being placed on one side of a post, and upon said bolt being placed on the opposite side of said post, and upon said threaded ends of said bolt being extended slidably through said bores in said fittings and upon said threaded bolts being threaded onto the ends of said bolt, said bolt and said hinge pin receiving block being drawn towards each other and said pair of pivotable members being caused to pivot with respect to said hinge pin receiving block and experience double-hinge action and conforming generally to said post regardless of the diameter thereof and thereby permitting said bolt and said hinge pin receiving block to be drawn further towards each other and into frictional engagement with said post sufficiently tightly to secure said double-hinged gate hinge to said post.

2. A gate hinge according to claim 1 wherein said pair of pivotable members are a pair of links of chain.

3. A gate hinge according to claim 1 wherein said bolt is a straight bolt.

4. A gate hinge according to claim 1 wherein said bolt is a U-bolt.

5. A gate hinge according to claim 1 wherein said hinge pin receiving block is provided with a serrated surface for engaging said post to thereby provide increased frictional engagement between said hinge pin receiving block and said post.

6. A gate hinge according to claim 1 wherein said hinge pin receiving block comprises a top flange portion and a bottom flange portion interconnected by a vertically extending bracket portion interconnecting said top and bottom flange portions and wherein said top and bottom flange portions are each provided with a bore extending vertically therethrough and wherein said vertically extending bores are in vertical alignment and are for receiving a hinge pin.

7. A gate hinge according to claim 1 wherein said pair of pivotal members are a pair of rigid generally arcuate shaped members.

8. A gate hinge according to claim 7 wherein each of said pair of rigid generally arcuate shaped members is provided with a serrated surface for facing and engaging said post and for providing increased frictional engagement between said rigid generally arcuate shaped members and said fence post.

9. A double-hinged gate hinge for being secured to post of different diameters, comprising:

a bolt having threaded ends for receiving threaded nuts;

a hinge pin receiving block;

a pair of pivotable members;

one end of each of said pivotable members being secured pivotally to one side of said hinge pin receiving block and the other end of each of said pivotable members being provided with a radially outwardly extending portion having an oversized bore extending therethrough;

upon said hinge pin receiving block being placed on one side of a post, and upon said bolt being placed on the opposite side of said post, and upon said threaded ends of said bolt being extended slidably through said oversized bores formed in said radially outwardly extending portions of said pivotable members and upon said threaded bolts being threaded onto the ends of said bolt, said bolt and said hinge pin receiving block being drawn towards each other and said pair of pivotable members being caused to pivot with respect to said hinge pin receiving block and experience double-hinge action and conforming generally to said post regardless of the diameter thereof and thereby permitting said bolt and said hinge pin receiving block to be drawn further towards each other and into frictional engagement with said post sufficiently tightly to secure said double-hinged gate hinge to said post.

* * * * *